US007313900B2

(12) United States Patent
Granili

(10) Patent No.: US 7,313,900 B2
(45) Date of Patent: Jan. 1, 2008

(54) METHOD AND APPARATUS FOR MANUFACTURING AN EASY-TO-OPEN PACKAGE

(75) Inventor: Andrea Granili, Lainate (IT)

(73) Assignee: Cryovac, Inc., Duncan, SC (US)

( * ) Notice: Subject to any disclaimer, the term of this patent is extended or adjusted under 35 U.S.C. 154(b) by 123 days.

(21) Appl. No.: 10/546,707

(22) PCT Filed: Feb. 4, 2004

(86) PCT No.: PCT/EP2004/001047

§ 371 (c)(1),
(2), (4) Date: Aug. 22, 2005

(87) PCT Pub. No.: WO2004/074106

PCT Pub. Date: Sep. 2, 2004

(65) Prior Publication Data

US 2006/0230708 A1 Oct. 19, 2006

(30) Foreign Application Priority Data

Feb. 21, 2003 (EP) ..... 03075505

(51) Int. Cl.
*B65B 11/52* (2006.01)

(52) U.S. Cl. ..... 53/427; 53/509; 53/133.3

(58) Field of Classification Search ..... 53/133.3, 53/373.2, 373.7, 374.7, 412, 427, 509
See application file for complete search history.

(56) References Cited

U.S. PATENT DOCUMENTS 2,784,539 A * 3/1957 Silver ..... 53/412
3,562,058 A * 2/1971 Boyd ..... 53/427
3,647,485 A * 3/1972 Seiferth et al. ..... 53/133.3
3,663,240 A * 5/1972 Seiferth et al. ..... 53/133.3
3,740,237 A * 6/1973 Grindrod et al. ..... 53/412
3,948,014 A * 4/1976 Wolfelsperger ..... 53/412
3,972,155 A * 8/1976 Mahaffy et al. ..... 53/427
4,196,809 A 4/1980 Tonrey
4,410,089 A 10/1983 Bortolani
4,833,862 A * 5/1989 Bortolani et al. ..... 53/427
4,901,505 A * 2/1990 Williams, Jr. ..... 53/412

(Continued)

FOREIGN PATENT DOCUMENTS

CA 1 164 260 3/1984
EP 0 748 746 6/1996

(Continued)

*Primary Examiner*—Louis Huynh
(74) *Attorney, Agent, or Firm*—Mark B. Quatt

(57) ABSTRACT

Disclosed is an apparatus for manufacturing, through a vacuum skin packaging (VSP) method, an easy-to-open package provided with a device for initiating the opening thereof. The apparatus includes a sealing station (115) wherein a top web (113) is sealed to a bottom web (104) in a first area (A) all around a product (P) arranged on the bottom web by providing heat and vacuum in a fundamentally closed chamber. The apparatus further includes a local sealing inhibition unit (130) including at least one removable local sealing inhibition tool (150) for inhibiting the sealing between the top and bottom webs in at least a second area (B). A method is also disclosed including the step of inhibiting the sealing between the top and bottom webs by arranging at least one removable local sealing inhibition tool between the top and bottom webs in at least a second area.

12 Claims, 6 Drawing Sheets

U.S. PATENT DOCUMENTS

| | | | | |
|---|---|---|---|---|
| 6,044,622 | A * | 4/2000 | Brady et al. | 53/412 |
| 6,625,955 | B2 * | 9/2003 | Aylward | 53/412 |
| 6,698,165 | B1 * | 3/2004 | Natterer | 53/412 |
| 6,843,042 | B2 * | 1/2005 | Nakabayashi et al. | 53/412 |

FOREIGN PATENT DOCUMENTS

| | | |
|---|---|---|
| GB | 1 360 808 | 11/1971 |
| GB | 1 510 115 | 6/1974 |

* cited by examiner (prior-art)

150
151
152

153
154

METHOD AND APPARATUS FOR MANUFACTURING AN EASY-TO-OPEN PACKAGE

The present application is a 35 USC §371 application of PCT/EP04/01047 filed Feb. 4, 2004, which claims the benefit of EP Patent Application No. 03075505.2 filed Feb. 21, 2003.

FIELD OF THE INVENTION

The present invention relates to an easy to open package wherein an article or product is enclosed between two webs, or layers, of thermoplastic material. More in particular, the present invention relates to a method and apparatus for manufacturing such an easy to open package.

BACKGROUND OF THE INVENTION

Packages wherein an article, for instance a food product or the like is enclosed between two webs (or layers) of thermoplastic material are well known. Generally, the so packaged food product is tightly sealed so as to protect it from abuse and exterior contamination during storage, shipment and display.

Presently, a wide variety of products, particularly food products, are being offered in visually attractive packages made of two superposed thermoplastic webs, a lower or bottom web and an upper or top web. Generally, the top web is transparent while the bottom web is properly colored and shaped and operates as a support for the packaged product. The package is made by different methods including, among the most popular ones, the vacuum skin packaging method.

In said method the lower, supporting, web has preferably a tray-like configuration defining a receptacle for the article to be packaged having an opening and a rim formed on the periphery of said opening. Said tray-like configuration is generally obtained by a thermoforming step, either in-line or off-line.

The upper web is generally drawn into a concave mold cavity formed into a vertically movable heated molding platen so that it is heated while held by suction in contact with the heated ceiling and walls of the cavity. Then, the vacuumization of the vacuum packaging chamber and the release of the suction applied to the cavity walls of the mold plate draws the upper web downwardly to contact with the contours of the product article and with the lower web. The upper web thus forms a tight skin all around the product and is bonded to the lower web by differential air pressure, thus sealing wherever the two webs contact each other.

Depending on the temperatures and materials employed for the upper web, a heat-sealing frame may be used to further seal the upper web to the peripheral rim of the lower web.

In said packages, the requirement for sufficiently strong heat seals to maintain the integrity of the package through the distribution channels and storage, should be balanced with that for easily openable heat seals to allow the end user to open the package by applying ordinary human hand force. In other words, there is the need to provide a perfect sealed package while having a packet that can be easily opened manually by the end consumer without using knives, scissors or any other dangerous cutting tool.

Several methods involving the proper selection and combination of materials have been devised in order to achieve the desired compromise.

These methods are essentially based either on the concept of having an easily peelable seal layer between the top or bottom webs so that upon application of an ordinary force, the two webs will separate one from the other, or on the concept of having the sealing layer, or one of the layers adjacent to the sealing layer, made of incompatible materials so that opening of the package is obtained by failure of the necessary cohesive force within said layer, upon the application of a tearing force from the outside, with breakage of the sealing layer if said layer of incompatible material is not the sealing one; or, still alternatively on the concept of having one of the layers adjacent to the sealing layer, easily delaminatable therefrom so that opening of the package is obtained upon application of an ordinary force by peeling of said adjacent layers and breakage of the sealing one.

For the purposes of the present application the term "easy to open package" is intended to refer to a package, and specifically heat sealed and bonded areas of a package, which, owing to the suitable selection of the composition of the upper and lower webs, and particularly that of the sealing layers and of the layers adjacent thereto, are readily openable.

In any case, independently on the devised easy-to-open mechanism, the opening of said packages still needs to be facilitated by a convenient means for pulling apart the top and bottom webs, namely, a device for the end user to start separating the two thermoplastic sheets one from another.

GB-B-1,360,808 discloses a package formed of superposed sealed webs of thermoplastic material with a corner of the package rendered easily openable by virtue of a paper insert between the webs in order to prevent localized sealing. While the solution according to GB-B-1,360,808 overcomes the main object to provide a device for starting the separation between the top and bottom layers, it has several disadvantages. The paper corner has to be glued to one of the layers. The use of glue with food products is highly undesirable as the food could become contaminated thereby. A special apparatus should be provided for applying the glue and the pieces of paper. A supply of both glue and paper pieces should be provided and an operator should monitor the status of supplies in order to always have glue and paper corners available. The special apparatus for gluing the paper to the layer should be precisely controlled in order to avoid that any excess of glue goes out of the proper area and bounds the top and bottom layers one to each other. The special apparatus is rather difficult to modify in case a different configuration of the bottom layer is provided. The packet is hardly recyclable as the paper is of a different nature with respect to the top and bottom layers. Finally, the cost of the glues and papers is not negligible.

GB-B-1,510,115 also discloses a package formed of superposed sealed webs of thermoplastic material in which a corner is rendered easily openable by virtue of a patch of ink that should prevent the two webs from bonding one to each other. Also the arrangement according to GB-B-1,510,115 works but has some disadvantages. The use of ink with food products is highly undesirable as the food could become contaminated thereby. Furthermore, the food could become colored by the ink and could result in being unmarketable. A special apparatus should be provided for applying the ink. A supply of ink should be provided and an operator should monitor the supply in order to always have ink enough. The special apparatus for ink application should be precisely controlled in order to avoid that any excess of ink goes out of the proper area. The special apparatus is rather difficult to modify in case a different configuration of the bottom layer is provided.

CA-B-1,164,260 describes a package wherein a corner of the lower web is bent downwardly by a punching device leaving the upper web without surface to adhere to at the sealing step. While this arrangement solves some of the above inconveniences, it still has some drawbacks. In fact, the apparatus needs an at least partial cutting tool. Such tool should be highly sharp otherwise it does not perform a perfect cut. This would result in a corner not perfectly bent and thus it would undesirably adhere to the upper surface. Again, the apparatus is rather difficult to modify in case a different configuration of the bottom layer is provided.

Vacuum skin packaging machines that provide for a pre-cut of a corner of the lower web which is then adhered to the upper web are commercially available. To start opening the package, the pre-cut corner must first be detached from the rest of the lower web by bending it upwardly or/and downwardly along the precut. In the case of the pre-cut corner, the corner cannot always be easily detached from the rest of the tray and sometimes bending it downwardly may break the upper web without being able to remove it first.

Finally, EP0,748,746 describes an easy to open package wherein it is readily apparent to the end user where to start the separation between the package webs, and gripping of the web to be torn apart and opening of the package is easier than with other known or commercially available means. In EP0,748,746 the lower thermoplastic web has at least one recess at a marginal zone of the peripheral rim providing in the upper web for an area of non-adhesion that can be finger gripped to initiate opening of the package. While this arrangement is rather effective, it still has some drawbacks. In fact, the apparatus needs a cutting tool. Such tool should be highly sharp otherwise it does not perform a perfect cut. Thus, the apparatus needs frequent maintenance and the cutting tools need to be frequently replaced otherwise the cut is not properly performed. Again, the apparatus is rather difficult to modify in case a different configuration of the bottom layer is provided.

The Applicant, in an attempt to solve the above problems, provided an apparatus wherein a removable piece of material was placed between the top web and the sealing dome of a sealing station. The object of such an interposition was to reduce the temperature at a certain area and thus to avoid the sealing in such a certain area. Unfortunately, the obtained results have not been found encouraging for two main reasons. From one side, a removable piece of low thickness was ineffective for reducing the sealing temperature. On the other side, a high thickness removable piece negatively affected the gasket properties and the corresponding vacuum drawn in the sealing chamber. This resulted in a non-perfect sealing.

In view of the above drawbacks, the main object of the present invention is providing a VSP easy-to-open package provided with an effective and reliable device for starting the separation between the top and lower webs and a VSP apparatus and method for manufacturing such an easy-to-open package.

A further object of the present invention is providing an apparatus and method for manufacturing an easy-to-open package wherein the device for starting the separation between the top and lower webs is not obtained through the use of glue.

A further object of the present invention is providing an apparatus and method for manufacturing an easy-to-open package wherein the device for starting the separation between the top and lower webs is not obtained by using paper pieces or the like to be stuck to either the top or bottom webs.

A further object of the present invention is providing an apparatus and method for manufacturing an easy-to-open package wherein the device for starting the separation between the top and lower webs is not obtained through the application of ink or the like.

A further object of the present invention is providing an apparatus and method for manufacturing an easy-to-open package wherein the device for starting the separation between the top and lower webs is not obtained by means of a cutting tool or the like.

These and further objects are obtained by a manufacturing apparatus and a manufacturing method according to claims 1 and 12, respectively. Further advantageous features of the present invention are set forth in the respective dependent claims. All the claims should be considered as an integral part of the present description.

The basic idea of the present invention is inhibiting the sealing of the top and bottom webs in a predetermined sealing area by inserting a removable tool between the top and bottom webs and removing the tool once the seal has been carried out.

SUMMARY OF THE INVENTION

According to a first aspect thereof, the present invention provides an apparatus for manufacturing, through a vacuum skin packaging method, an easy-to-open package provided with a device for initiating the opening thereof, the apparatus comprising a sealing station wherein a top web is sealed to a bottom web in a first area all around a product arranged on the bottom web by providing heat and vacuum in a fundamentally closed chamber, characterized in that it further comprises a local sealing inhibition unit comprising at least one removable local sealing inhibition tool for inhibiting the sealing between the top and bottom webs in at least a second area.

Preferably, the local sealing inhibition unit further comprises a device for moving the at least one removable local sealing inhibition tool in a working position cooperating with the sealing station and back to a position not cooperating with the sealing station.

Preferably, the local sealing inhibition tool is made, at least partially, of a material selected from the group consisting of fluorocarbon resins including polytetrafluoroethylene (PTFE), fluoroethylene polymers (FEP) and copolymers thereof, and more preferably of PTFE.

Preferably, the local sealing inhibition unit comprises a cooling unit for cooling the at least one local sealing inhibition tool.

According to a second aspect thereof, the present invention provides a vacuum skin packaging method for manufacturing an easy-to-open package provided with a device for starting the aperture thereof, the method comprising the step of sealing a top web to a bottom web in a first area all around a product that is arranged on the bottom web, said sealing step comprising the step of providing heat and vacuum in a fundamentally closed chamber, characterized by the step of inhibiting the sealing between the top and bottom webs in at least a second area by arranging at least one removable local sealing inhibition tool between the top and bottom webs, in said second area.

BRIEF DESCRIPTION OF THE DRAWINGS

The present invention will become fully clear after reading the following detailed description thereof, given merely as an example and not by limitation, to be read with reference to the attached sheets of drawings, wherein:

FIGS. 6*a*-6*l* shows, in top plant view and cross-section, some embodiments of local sealing inhibition tools according to the invention.

DETAILED DESCRIPTION OF THE INVENTION

The same reference numbers will be used through the following description for indicating the same or functionally equivalent parts.

Figure 1:
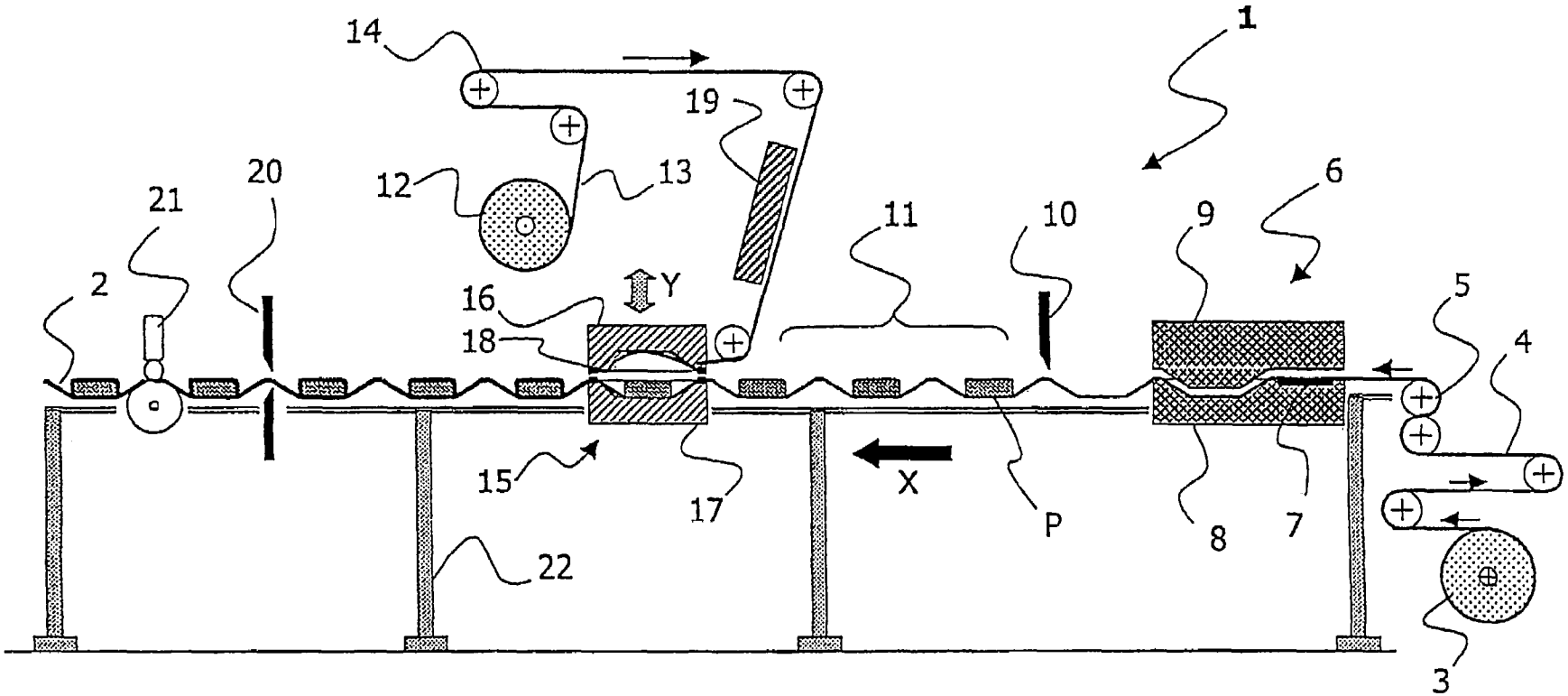
FIG. 1 schematically shows a prior-art apparatus for manufacturing an easy-to-open package wherein a corner is cut.

With first reference to FIG. 1, an apparatus 1 for manufacturing an easy-to-open package 2 according to the prior-art is shown. The working direction is indicated by arrow X and is from right to left. The apparatus 1 comprises: a first reel 3 for the bottom web (or layer) 4; a first pulley arrangement 5 for unwinding the bottom web 4; an on-line thermo-forming station 6 where the bottom web 4 is tray shaped; a corner cutting device section 10; a (food) product placing area 11 where products P are placed onto the tray shaped web; a second reel 12 for the top web 13; a second pulley arrangement 14 for unwinding the top web 13; a sealing station 15; a cross cutting unit 20; and a longitudinal cutting unit 21. A finished package 2 is finally obtained. A main frame 22 supports the above listed components.

Typically, the on-line thermo-forming station 6 comprises a heating plate 7, a forming lower plate 8 and an upper forming tray 9.

Typically, the corner cutting section 10 comprises at least one cuffing tool for performing precise angled short cuttings on the tray shaped bottom layer.

Typically, the sealing station 15 comprises an upper sealing dome 16 and a die bottom 17 with a forming plate (and possibly with plates for changing the forming depth, not shown). A gasket 18 is arranged at the edge of either one or both the upper sealing dome and the die bottom. Both the upper sealing dome and the bottom die are provided with slits (not shown) for drawing vacuum and ventilating when the upper dome and the bottom die are closed.

The operation of the sealing station is as follows. Before closing the upper dome and the bottom die, one or more lower web trays with products thereon are introduced. A length of upper web, possibly pre-heated by a pre-heating plate 19, is also drawn by the upper dome. When the upper dome and the bottom die are closed, vacuum from above draws the web into the dome while vacuum from below draws the tray(s) into a mould. The upper web is heated up to a certain temperature (for instance, about 200° C.) in the dome and air in the package is evacuated through slits. When the vacuum from above ends, gentle ventilation from above causes the upper web to detach from the dome. Through full ventilation from above, the upper web is sealed to the tray(s) all around the product and the tray(s) stabilized in the mould that is cooled. The die bottom is also ventilated and the sealing station is opened in order to move the sealed packages to the cross and longitudinal cutting stations, thus leaving the sealing station ready for sealing a new set of trays.

The longitudinal cutting station 21 is provided as, generally, more than one tray is formed in a bottom web length. In other words, when the tray shaped bottom web is seen from above, a number of lanes of trays is seen.

Figure 2:
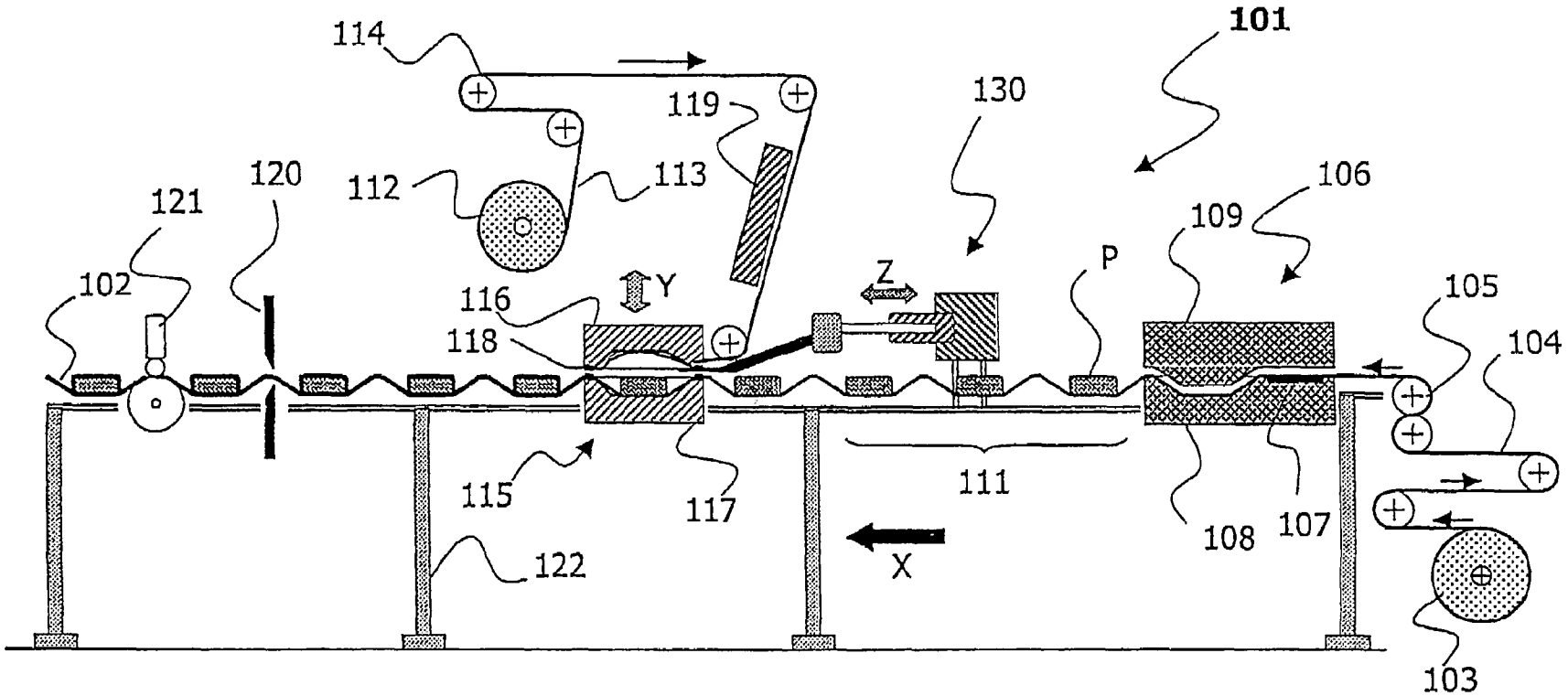
FIG. 2 schematically shows a manufacturing apparatus according to the present invention.
Figure 3:
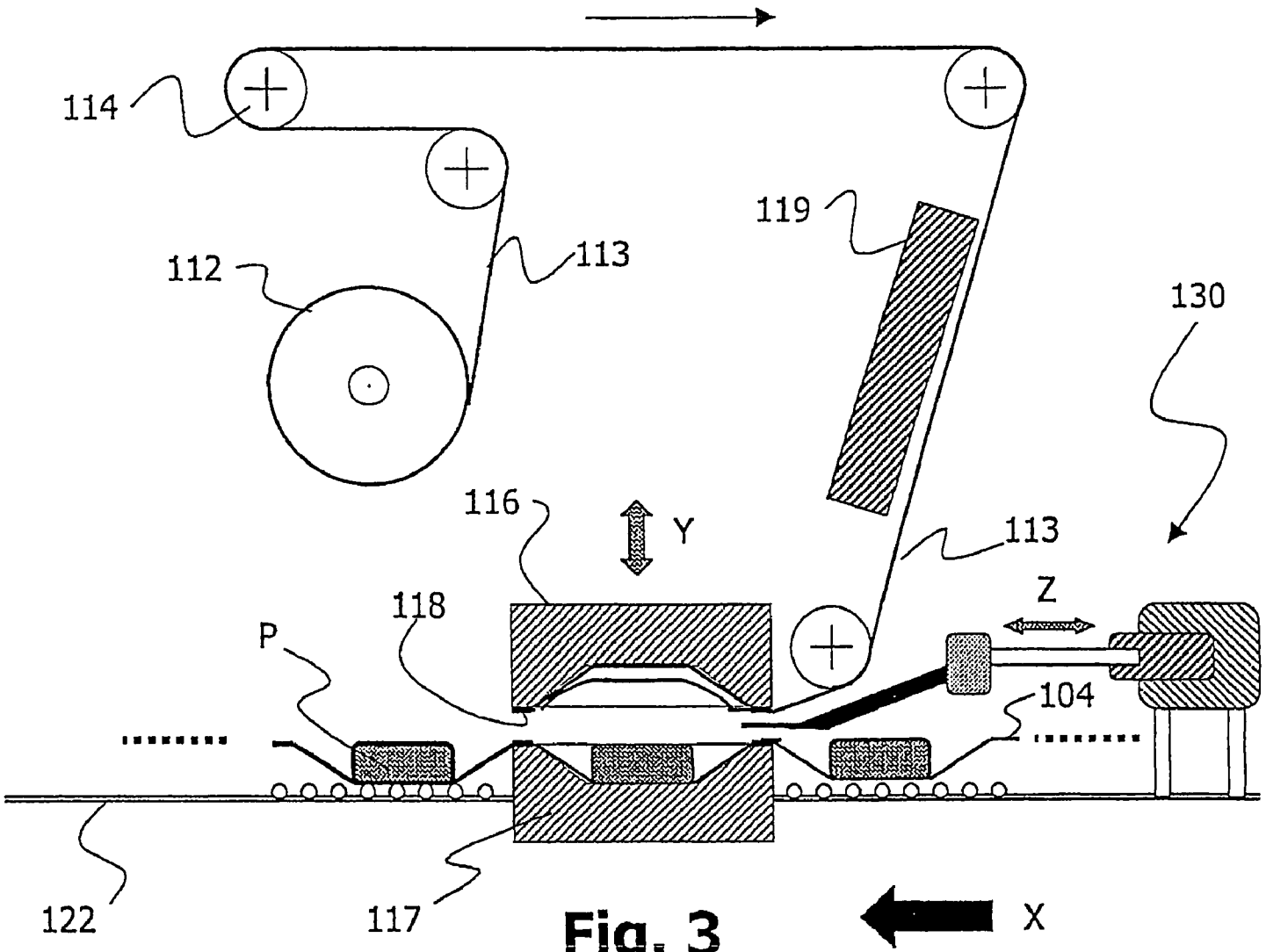
FIG. 3 schematically shows the sealing inhibition unit of the manufacturing apparatus according to the present invention.

FIG. 2 schematically shows an embodiment of the manufacturing apparatus. 101 according to the present invention. The apparatus 101 is similar to the prior-art apparatus 1 and comprises: a first reel 103 for the bottom web (or layer) 104; a first pulley arrangement 105 for unwinding the bottom web 104; a forming station 106 where the bottom web 104 is tray shaped; a (food) product placing area 111 where products P are placed onto the tray shaped web; a second reel 112 for the top web 113; a second pulley arrangement 114 for unwinding the top web 113; a sealing station 115; a cross cuffing unit 120; and a longitudinal cuffing unit 121. A finished package 102 is finally obtained. Thus, the apparatus 101 lacks a corner cutting station. In addition, at the entrance of the sealing station 115, a local sealing inhibition unit 130 is provided.

Possibly, the operation of the forming station 106 is the same as the operation of the forming station 6. Furthermore, also the operation of the sealing station 115 is similar to the one of station 15, except for the cooperation with the local sealing inhibition unit 130, as will be explained below.

The sealing station 115 is such that the top web 113 is sealed (and adherent) to the bottom web 104 in a first area A on and all around the product P. The interposition of a removable local sealing inhibition tool 150 produces a second area B where the top and bottom webs do not adhere one with each other.

Figure 4:
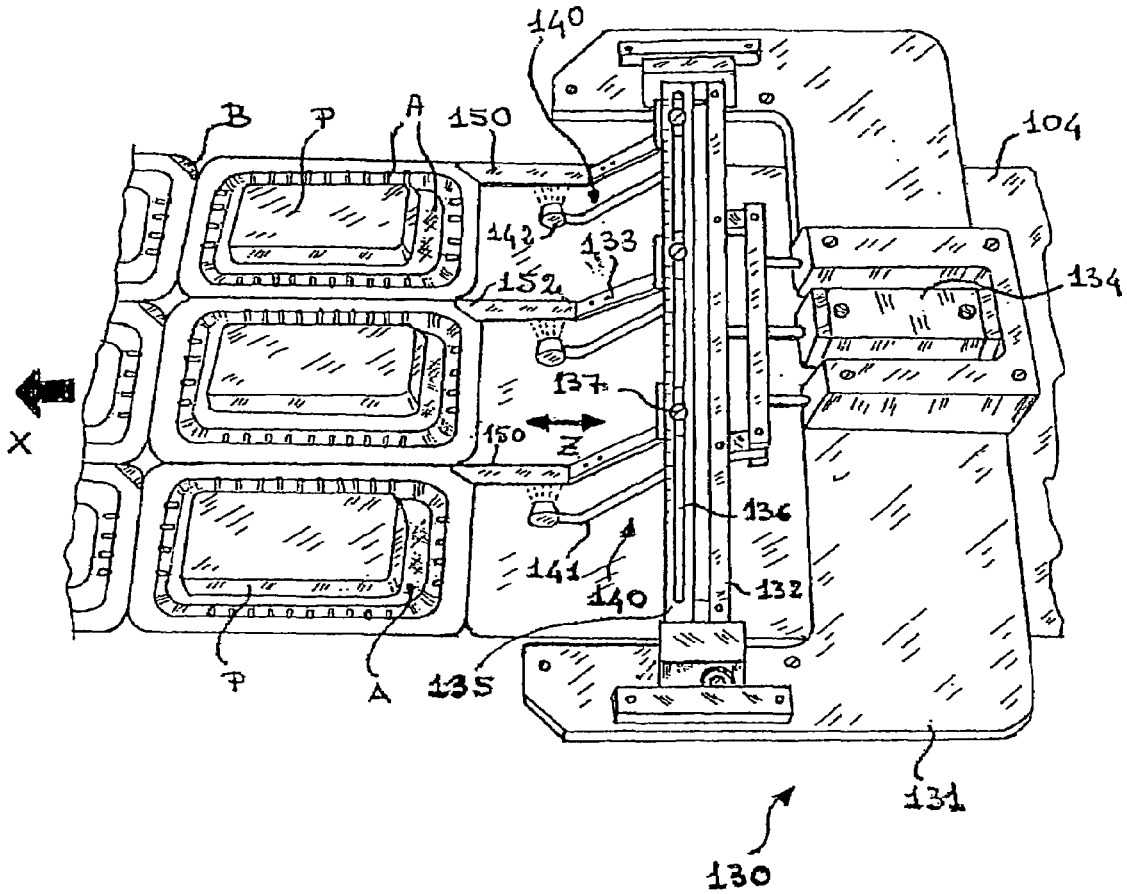
FIG. 4 schematically shows a perspective view of the sealing inhibition unit of the manufacturing apparatus according to the present invention.

With reference to FIG. 4, in a preferred embodiment thereof, the local sealing inhibition unit 130 according to the present invention comprises a basement 131, an arm 132, one or more extensions 133 connected to the arm 132 at one of their ends and to respective local sealing inhibition tools 150 at the other ends. Possibly, the basement is connected to the main frame 122 of the apparatus 101 at a raised position so that the trays (being loaded with the products P) are free to move in the working direction X. It should be noticed that in order to better illustrate the system and its operation, in FIGS. 4 and 5 the shape of the trays and the product loaded therein, in the last row is not shown.

In the preferred embodiment thereof, the arm is connected to the basement 131 through one or more pneumatic or hydraulic actuator 134 having a stroke (see arrow Z) for moving the extensions 133 and the corresponding local sealing inhibition tools 150 both in the working direction X and in the opposite one.

Figure 5:
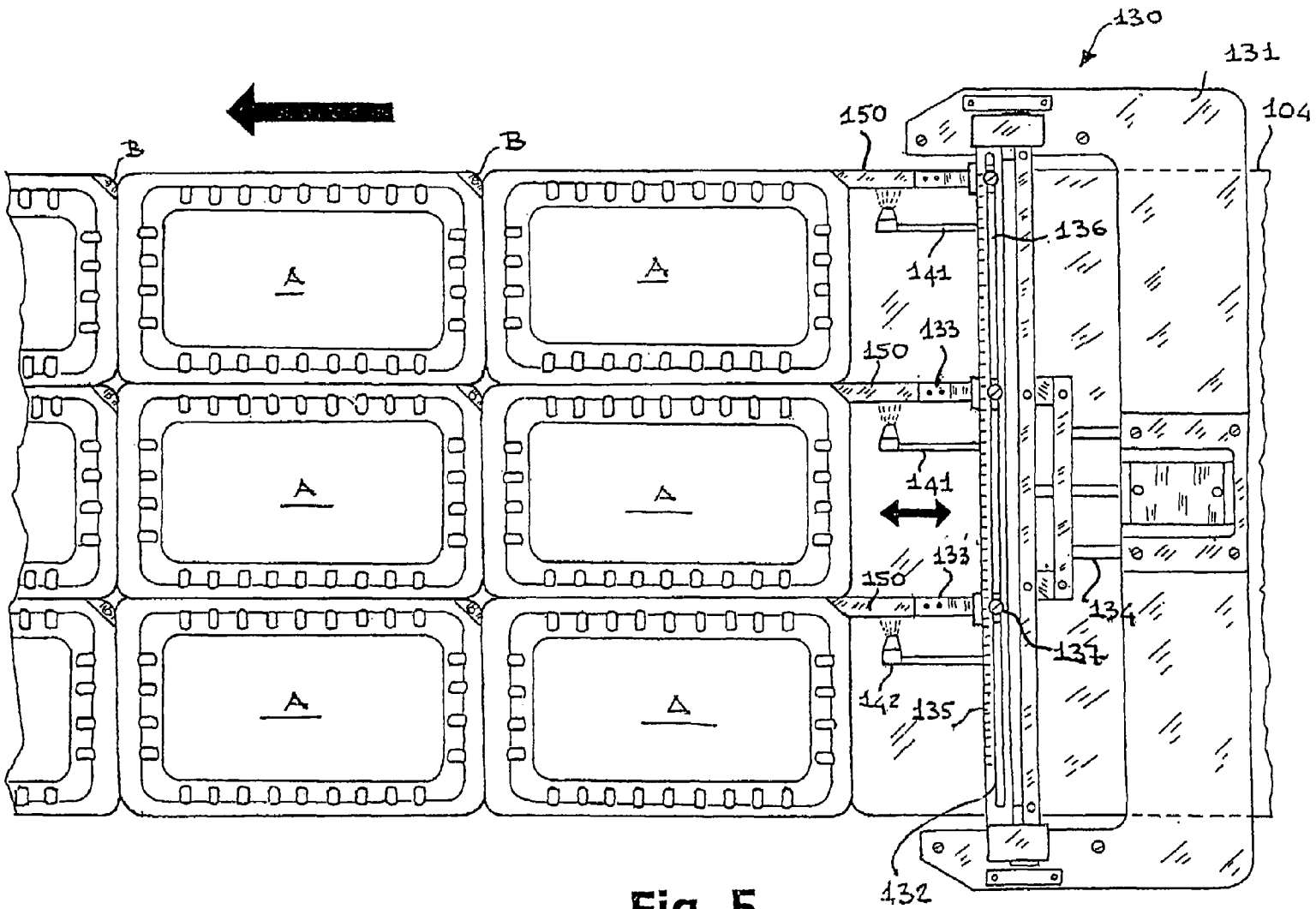
FIG. 5 schematically shows a top plant view of the sealing inhibition unit of the manufacturing apparatus according to the present invention.

As it is shown in FIGS. 4 and 5, the arm 132 comprises a bar 135 with a slot 136 extending fundamentally transversely to the working direction X. Each of the extensions 133 is connected to the arm 132 by a screw and nut arrangement 137, with the screw being inserted into the slot 136. In this way, profitably, the extension configuration can be easily changed just by loosening the screw-nut assembly 137, shifting the extensions 133 to the proper position and bolting again the screw-nut arrangement 137. This feature is highly advantageous as more than one tray is generally formed in a bottom web length. With reference to FIGS. 4 and 5, for instance, three lanes of mutually parallel packages are shown. It should be clear that the present invention applies equally to any number (lower or higher) of lanes of mutually parallel packages.

Thus, the man skilled in the art will recognize that providing a manufacturing apparatus with, for instance, four lanes of trays (namely four smaller trays in the same bottom web width) will be easily carried out by properly moving the three existing extensions and by adding a further extension at a proper position. Analogously, providing a manufacturing apparatus with two lanes of trays (namely two larger trays in the same bottom web width) will be easily carried out by removing one of the three existing extensions and by properly moving the remaining two extensions at proper positions.

Profitably, in order to easily and promptly locate the correct positions of the extensions, the slotted bar 135 comprises position indicators, possibly a graduated scale in at least one measure unit.

Each extension 133 bears, at the lower end thereof, a local sealing inhibition tool 150. The local sealing inhibition tool 150 comprises a rather thin and elongate plate member 151.

Figures 6A, 6B, 6C, 6D, 6E, 6F, 6G, 6H, 6I, 6L:
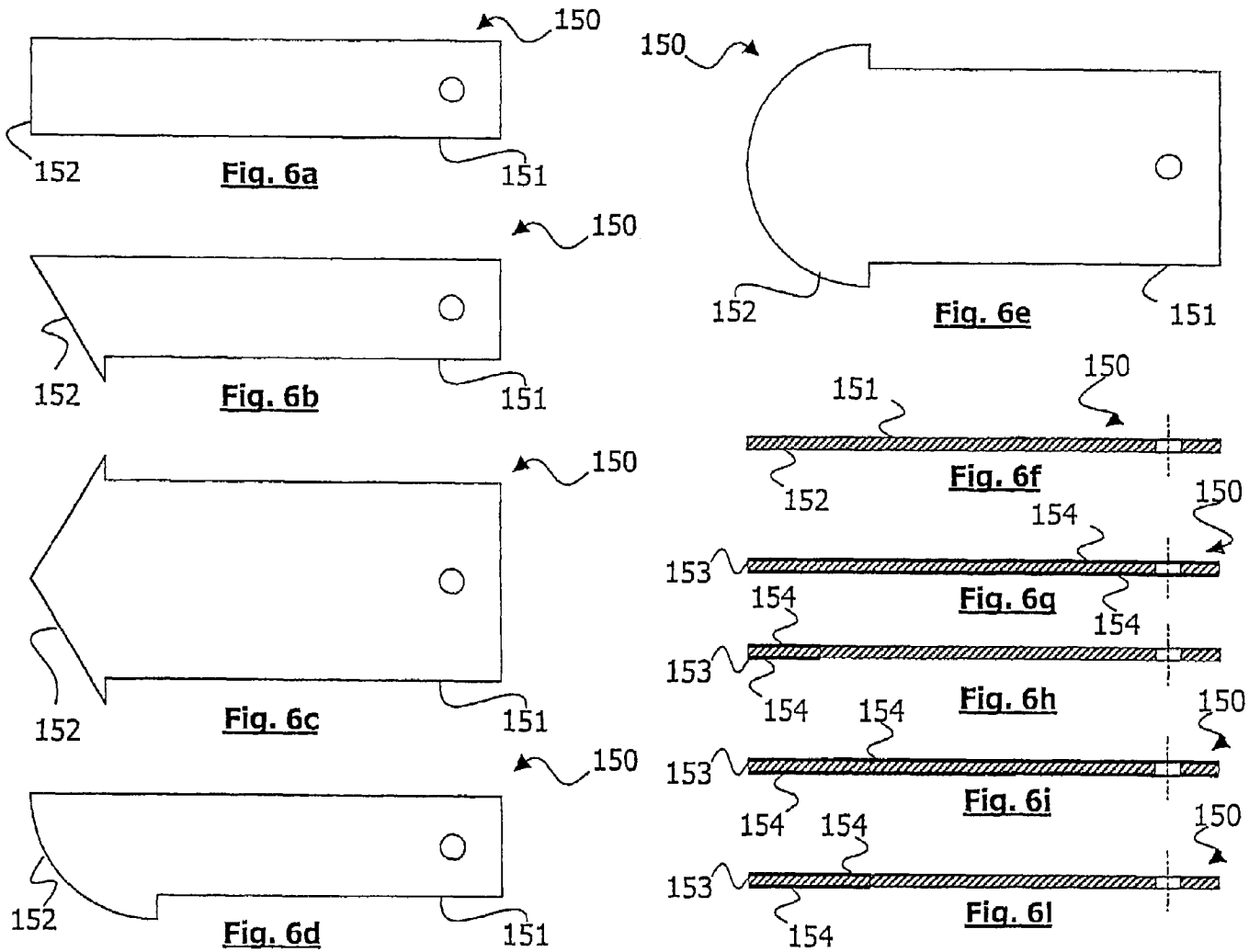

According to a first preferred embodiment (see FIGS. 6*a* and 6*f*), the local sealing inhibition tool has a fundamentally rectangular shape.

According to a second preferred embodiment (see FIGS. 6*b* and 6*f*), the local sealing inhibition tool 150 has a fundamentally rectangular shape with a half-arrow shape at one end (the free end 152 opposite to the one connecting to the corresponding extension).

According to a third preferred embodiment (see FIGS. 6*d* and 6*f*), the local sealing inhibition tool 150 has a fundamentally rectangular shape with a one forth of circumference curved free end 152.

According to a fourth preferred embodiment (see FIGS. 6*c* and 6*f*), the local sealing inhibition tool has a fundamentally rectangular shape with a full-arrow shape at the free end 152. From one side, a so shaped tool allows for reducing the number of extensions and tools as one tool operates for two adjacent trays. From the other side, a so shaped tool allows for creating an easy-to-open package wherein two corners can be gripped by the end user for separating the top and bottom webs.

According to a fifth preferred embodiment (see FIGS. 6*e* and 6*f*), the local sealing inhibition tool has a fundamentally rectangular shape with a semicircular shape at the free end 152. The advantages are the same as for the forth embodiment.

According to a sixth preferred embodiment (not shown), the local sealing inhibition tool has a fundamentally rectangular shape and it has a width as the width of the package. A so shaped tool allows for creating an easy-to-open package wherein an entire side can be gripped by the end user for separating the top and bottom webs. When the web contains two or more lanes it is possible to use a local sealing inhibition tool with a substantially rectangular shape as wide as the web. In such a case, in order to avoid any interference between said strip and the products loaded in the trays, the strip is inclined downwardly relative to the path of advance of the web.

With reference to FIG. 4 and FIG. 5, the local sealing inhibition unit 130 further comprises a cooling unit 140 for cooling the local sealing inhibition tools 150, possibly after each sealing cycle. The cooling unit 140 comprises a source (not shown) of cooling medium, possibly a source of compressed air, tubes 141 for bringing the cooling medium near the local sealing inhibition tools 150, and corresponding nozzles 142 for blowing the cooling medium towards the local sealing inhibition tools.

The operation of the local sealing inhibition unit 130 will be now described. Through the pneumatic or hydraulic actuator 134, the arm 132 is moved towards the sealing station 115 so that the free end 152 of the local sealing inhibition tool 150 reaches a position wherein it is under the edge of the upper sealing dome 116 (and up to the edge of the bottom die 117). According to the present invention, when the upper sealing dome and the bottom die close, the sealing inhibition tool 150 (or at least its free end 152) is sandwiched between the top and the bottom webs. The interposition of the tool 150 at least in a location between the upper and lower webs avoids the adhesion of the two webs in such a localized area. At the end of the sealing process, when one or both of the sealing dome and the bottom die vertically move and separate, the arm 132 is returned to the starting position (so that the sealing inhibition tools become out of the influence area of the sealing station); the sealed packages are moved in the working direction and further packages to be sealed are moved to the sealing station itself.

When the tools 150 are not operating, namely after a sealing cycle, preferably the sealing inhibition tools are cooled through the tool cooling unit 140. While this cooling operation is optional, especially when proper materials are selected for the local sealing inhibition tools, profitably it increases the operating life of the local sealing inhibition tools that are subject to high temperatures during the sealing cycle.

It is well known that a good sealing is obtained through a high vacuum between the upper sealing dome and the bottom die. For this reason, conventionally the gasket 118 is placed at the edge of the dome and/or the bottom die. In any case, notwithstanding the gasket, it is highly advisable to have thin local sealing inhibition tools. A possible thickness for the local sealing inhibition tools could range between about 0.3 mm and about 0.8 mm, preferably between about 0.4 mm and about 0.6 mm, and still preferably is about 0.5 mm. When a 0.5 mm thick tool has been used, good sealing results have been obtained.

The local sealing inhibition tools 150 are made of a material with thermal insulating, high temperature resistance and heath dispersion characteristics. In any case, the selected material should not be sticking even at high temperatures. In addition, the selected material should have other mechanical characteristics as compression resistance and rather high flexibility.

According to a preferred embodiment of the present invention, the local sealing inhibition tools are made of fluorocarbon resins, including polytetrafluoroethylene (PTFE), fluoroethylene polymers (FEP) and various copolymers. Particularly preferred would be local sealing inhibition tools made of Teflon®, DuPont trademark covering all of its fluorocarbon resins. In a most preferred embodiment of the present invention, the local sealing inhibition tools are made of polytetrafluoroethylene plastic, a highly crystalline plastic with a very high thermal stability, excellent electrical insulation properties and low coefficient of friction in a wide temperature range.

According to a further preferred embodiment of the present invention (see FIGS. 6*g* and 6*i*), the local sealing inhibition tool 150 comprises a thin core 153 of metal or the like and one or two coatings 154 of Teflon®, PTFE or any mixture thereof. Advantageously, only the free ends 152 of the sealing inhibition tools 150 are coated (see FIGS. 6*h* and 6*l*). The thin metal core 153 could be about 0.3 mm thick and each of the upper and lower coatings 154 could be about 0.1 mm thick.

While the local sealing inhibition unit 130 has been shown and described upstream of the sealing station, in principle it could be arranged downstream thereof, laterally or according a combination of the various arrangements.

The dimensions of the local sealing inhibition tools and of the area of non-adhesion between the bottom and the top webs (that at most corresponds to the size of the seal inhibition tool but is generally smaller, typically corresponding to the size of the free end 152) can vary according to the dimensions of the package and of the peripheral rim, provided however that it is sufficient to allow for an easy gripping by an ordinary hand. Generally, packages from about 8 cm to about 20 cm in width and from about 15 cm to about 30 cm in length are manufactured with a rim width ranging from about 1.0 cm and about 3.0 cm. In view of this, each local sealing inhibition tool is generally about 1-3 cm large and 3-8 cm long, and the size of the non sealed area that can suitably be obtained using such seal inhibition tools would typically be 1-3 cm in width and 1-4 cm in length, preferably about 1-2 cm in width and 1-3 cm in length. Needless to say that where a strip is used having the same width as the package, then the dimensions of the non-sealed ones will vary accordingly.

The lower web used for the manufacture of the easy to open package according to the present invention preferably comprises a multilayer laminated structure having flexibility characteristics which may vary depending on the end use. Rigid and semi-rigid gas barrier structures are generally preferred. Typically they comprise one or more bulk layers, such as polystyrene, polypropylene, or polyester-based layers, a gas-barrier layer if the bulk layer does not confer sufficient gas-barrier properties, a suitably selected sealant layer, that may be peelable, optionally an inner layer adjacent to the sealable layer that may comprise incompatible resins or may easily delaminate from the adjacent sealant layer, to provide for an easy openable structure, tie layers, if and where necessary to increase the bond between the various layers, and the like layers. These structures may be solid or partially foamed, where at least the gas-barrier layer is solid. Thickness of the lower web is generally comprised between 100 and 1,000 μm, preferably between 150 and 800 μm and more preferably between 150 and 350 μm for solid structures and between 350 and 700 μm for the partially foamed ones. The top web is typically a multi-layer formable structure, preferably non oriented, comprising one or more bulk layers of ethylene homo- or copolymers, an ionomer, a polyester or any other thermoformable resin, a gas-barrier layer, preferably comprising ethylene-vinyl alcohol copolymer and/or polyamides, and a suitably selected sealing layer, typically comprising an ethylene homo- or copolymer or an ionomer. Preferably the structure of the top web is cross-linked by irradiation. Thickness of typical upper webs to be used in VSP is from about 40 to about 300 μm, preferably from about 50 to about 250 μm and more preferably from about 60 to about 180 μm.

It should be clear that in both FIGS. 4 and 5, the top web 113 and the sealing station 115 have not been shown for clarity. In addition, in FIG. 5, also the product P has not been shown for clarity.

Throughout the present description, the shape of the thermoformed lower web has been described and shown as being fundamentally rectangular as this is the shape that is conventionally used. It will however be understood that virtually any shape of the superposed webs can be provided according to the present invention. Of course, when the tray shape is circular, elliptical or has rounded corners, the device for pulling apart the package according to the invention will not be at a corner of the package as, in principle, there are no corners.

In some instances, particularly when a clear bottom web is employed, it might be advisable to facilitate the identification of the unsealed corner by the end user. This can be done e.g. by suitably printing the top web in correspondence of the unsealed corner or by suitably thermoforming the bottom web so as to distinguish the corner that will be unsealed from the other ones, e.g. by creating a protuberance, either downwardly or upwardly, in correspondence with the unsealed corner. The presence of such a protuberance in addition to enable the identification of the unsealed corner, would also help in pulling the top film to open the package.

Briefly, with reference to the various figures and in particular to FIGS. 4 and 5, the present invention relates to an apparatus 101 for manufacturing, through a vacuum skin packaging method, an easy-to-open package provided with a device for initiating the opening thereof, the apparatus comprising a sealing station 115 wherein a top web 113 is sealed to a bottom web 104 in a first area A on and all around a product P arranged on the bottom web by providing heat and vacuum in a fundamentally closed chamber, characterized in that it further comprises a local sealing inhibition unit 130 comprising at least one removable local sealing inhibition tool 150 for inhibiting the sealing between the top and bottom webs 113, 104 in at least a second area B.

The present invention also relates to a vacuum skin packaging method for manufacturing an easy-to-open package provided with a device for starting the aperture thereof, the method comprising the step of sealing a top web 113 to a bottom web 104 in a first area A all around a product P that is arranged on the bottom web, said sealing step comprising the step of providing heat and vacuum in a fundamentally closed chamber, characterized by the step of inhibiting the sealing between the top and bottom webs 113, 104 in at least a second area B by arranging at least one removable local sealing inhibition tool 150 between the top and bottom webs 113, 104, in said second area.

There have thus been shown and described a novel VSP manufacturing apparatus and a novel VSP manufacturing method which fulfill all the objects and advantages sought therefore. Many changes, modifications, variations and other uses and applications of the subject invention will, however, become apparent to those skilled in the art after considering the specification and the accompanying drawings which disclose preferred embodiments thereof. All such changes, modifications, variations and other uses and applications that do not depart from the scope of the invention are deemed to be covered by the invention.

What is claimed is:

1. A vacuum skin packaging method for manufacturing an easy-to-open package provided with a device for initiating the opening thereof, the method comprising:

a) the step of sealing a top web (113) to a bottom web (104) in a first area (A) all around a product (P) that is arranged on the bottom web, in a sealing station having an upper sealing dome and a die bottom, said sealing step comprising the steps of i) drawing the top web by vacuum into the upper sealing dome, ii) drawing the bottom web by vacuum into the die bottom, iii) heating the top web, iv) evacuating air between the top and bottom webs, and v) releasing the top web from the upper sealing dome such that the top web is sealed to the bottom web in the first area (A) all around the product (P) in a fundamentally closed chamber formed between the upper sealing dome and the die bottom, and b) the step of inhibiting the sealing between the top and bottom webs (113, 104) in at least a second area (B) by arranging at least one removable local sealing inhibition tool (150) between the top and bottom webs (113, 104), in said second area, by moving the at least one removable local sealing inhibition tool (150) in a working position cooperating with the sealing station (115) and back to a position not cooperating with the sealing station (115), where the working position is a position between the top and bottom webs (113, 104) and at least partially within the fundamentally closed chamber of the sealing station (115).

2. The method of claim 1, characterized in that the step of arranging at least one removable local sealing inhibition tool (150) comprises the step of arranging at least one tool (150) comprising a fluorocarbon resin.

3. The method of claim 1, comprising the step of cooling the at least one local sealing inhibition tool (150).

4. An apparatus (101) for manufacturing, through a vacuum skin packaging method, an easy-to-open package provided with a device for initiating the opening thereof, the apparatus comprising a) sealing station (115), the sealing station comprising i) an upper sealing dome (116), and ii) a die bottom (117);

wherein a top web (113) is sealed to a bottom web (104) in a first area (A) all around a product (P) arranged on the bottom web by drawing the top web by vacuum into the upper sealing dome, drawing the bottom web by vacuum into the die bottom, heating the top web, evacuating air between the top and bottom webs, and releasing the top web from the upper sealing dome such that the top web is sealed to the bottom web in the first area (A) all around the product (P) in a fundamentally closed chamber formed between the upper sealing dome and the die bottom, and b) a local sealing inhibition unit (130) comprising at least one removable local sealing inhibition tool (150) for inhibiting the sealing between the top and bottom webs (113,104) in at least a second area (B), the local sealing inhibition unit (130) further comprises a device (134) for moving the at least one removable local sealing inhibition tool (150) in a working position cooperating with the sealing station (115) and back to a position not cooperating with the sealing station (115), characterized in that the working position is a position between the top and bottom webs (113, 104) and at least partially within the fundamentally closed chamber of the sealing station (115).

5. The apparatus of claim 4, characterized in that the removable local sealing inhibition tool (150) comprises a plate member (151) having a free-end (152).

6. The apparatus of claim 5, characterized in that the free-end (152) of the plate member (151) is fundamentally arrow-shaped.

7. The apparatus of claim 5, characterized in that the free-end (152) of the plate member (151) is shaped fundamentally according to a circle arc.

8. The apparatus of claim 4, characterized in that the local sealing inhibition tool (150) comprises a fluorocarbon resin.

9. The apparatus of claim 4, characterized in that the local sealing inhibition tool (150) comprises a core (153) and at least one coating (154) that comprises a fluorocarbon resin.

10. The apparatus of claim 4, characterized in that the local sealing inhibition unit (130) comprises a cooling unit (140) for cooling the at least one local sealing inhibition tool (150).

11. The apparatus of claim 4, characterized in that the local sealing inhibition unit (130) comprises an arm (132) with one or more protruding extensions (133) carrying corresponding tools (150) at their ends, the arm (132) comprising a bar (135) with a slot (136) for changing the configuration of the tools (150).

12. The apparatus of claim 4, characterized in that the device (134) for moving the at least one removable local sealing inhibition tool (150) comprises a pneumatic or hydraulic piston arrangement.

* * * * *